US008141524B2

(12) United States Patent
White et al.

(10) Patent No.: US 8,141,524 B2
(45) Date of Patent: Mar. 27, 2012

(54) COOLING SYSTEM HAVING VARIABLE ORIFICE PLATES

(75) Inventors: Ryan A. White, Stockbridge, GA (US); John H. Lovell, Griffin, GA (US); Nader W. Ktami, Griffin, GA (US)

(73) Assignee: Caterpillar Inc., Peoria, IL (US)

( * ) Notice: Subject to any disclaimer, the term of this patent is extended or adjusted under 35 U.S.C. 154(b) by 702 days.

(21) Appl. No.: 12/314,691

(22) Filed: Dec. 15, 2008

(65) Prior Publication Data

US 2010/0147489 A1 Jun. 17, 2010

(51) Int. Cl.
*F01P 9/00* (2006.01)

(52) U.S. Cl. ..... 123/41.01; 251/205; 123/41.08; 165/11.2

(58) Field of Classification Search ..... 123/41.01, 123/41.08, 41.15; 165/11.2; 251/205–209
See application file for complete search history.

(56) References Cited

U.S. PATENT DOCUMENTS 2,013,113 A 9/1935 Simpson
2,095,656 A 10/1937 Wells
3,124,162 A * 3/1964 Cameron ..... 137/625.11
3,269,652 A * 8/1966 Warhol ..... 236/34
3,367,112 A 2/1968 Mainhardt
3,517,697 A 6/1970 Hott, Jr. et al.
3,871,444 A 3/1975 Houser et al.
3,889,878 A * 6/1975 Evans ..... 237/8 R
4,098,296 A 7/1978 Grasso et al.
4,161,307 A 7/1979 Clinch et al.
4,360,040 A 11/1982 Cove et al.
4,432,512 A 2/1984 Young
4,469,133 A 9/1984 Boesing et al.
4,516,606 A * 5/1985 Worley ..... 137/625.3
4,748,942 A * 6/1988 Ferrari ..... 123/41.02
6,189,519 B1 * 2/2001 Press et al. ..... 123/568.26
6,450,134 B1 9/2002 Del Sole
6,659,050 B1 12/2003 Creech et al.
6,736,165 B2 5/2004 Bender
7,429,005 B2 9/2008 Schapper

* cited by examiner

*Primary Examiner* — Michael Cuff
*Assistant Examiner* — Hung Q Nguyen
(74) *Attorney, Agent, or Firm* — Finnegan, Henderson, Farabow, Garrett & Dunner LLP

(57) ABSTRACT

A cooling system for an engine is disclosed. The cooling system may have an engine, a pump configured to receive coolant from the engine and generate a flow of coolant, and a heat exchanger configured to receive the coolant flow. The cooling system may also have a plurality of orifice plates located between the pump and the heat exchanger. At least one of the plurality of orifice plates may be adjustable to control the flow of the coolant from the engine to the heat exchanger.

18 Claims, 4 Drawing Sheets

COOLING SYSTEM HAVING VARIABLE ORIFICE PLATES

TECHNICAL FIELD

The present disclosure relates generally to a cooling system and, more particularly, to a cooling system having variable orifice plates.

BACKGROUND

Engines, including diesel engines, gasoline engines, and gaseous fuel-powered engines are used to generate mechanical, hydraulic, or electrical power output. In order to accomplish this power generation, an engine typically combusts a fuel/air mixture. With the purpose to ensure optimum combustion of the fuel/air mixture and protect components of the engine from damaging extremes, the temperature of the engine and air drawn into the engine for combustion must be tightly controlled.

An internal combustion engine is generally fluidly connected to several different liquid-to-air and/or air-to air heat exchangers to cool both liquids and gases circulated throughout the engine. These heat exchangers are often located close together and/or close to the engine to conserve space. An engine driven fan or pump is disposed either in front of the engine/exchanger package to blow air across the exchangers and the engine, or between the exchangers and engine to suck air past the exchangers and blow air past the engine, the airflow removing heat from the heat exchangers and the engine. In other arrangements cooling fluids from the environment, for example water from a marine environment, can be directed through the engine/exchanger package to remove heat therefrom.

In some embodiments the engine and/or the heat exchanger can be installed by the customer or according to customer requirements. In these situations, a distance from the engine to the heat exchanger can vary. When the heat exchanger is installed close to the engine, coolant flow from the engine through the heat exchanger can be too great and cause wear to the heat exchanger and other engine components. In addition, the increased flow can cool the engine too much such that oil used to lubricate components of the engine becomes viscous, causing significant friction and possibly damage within the engine. When air drawn into the engine is too cold, combustion of the fuel/air mixture may be poor resulting in poor load acceptance, white smoke production, and poor fuel efficiency. When the heat exchanger is mounted too far from the engine, the cooling capability of the heat exchanger decreases, resulting in overheating of the engine and/or poor fuel efficiency.

An exemplary heat exchanger arrangement is disclosed in U.S. Pat. No. 2,013,113 (the '113 patent) issued to Simpson on Jul. 22, 1932. The '113 patent describes a heating system having a boiler, adjusting plates, and one or more radiators. Typically, steam is generated within the boiler and provided to the radiators so that radiators close to the boiler fill quickly, and radiators located a distance away from the boiler do not receive a full amount of steam. The '113 patent describes a fixed plate with a semicircular orifice at one side of center, and an adjustable plate with a semicircular shape connected to the fixed plate by a pivot. The adjustable plate is confined by friction and is adjusted to any desire position about the pivot. The fixed member is provided with a series of graduations as an indicator to adjust the orifice opening from a maximum to a minimum opening based on a desired amount of steam. The regulation of flow provided by the adjustable plate permits a user to balance the steam distribution uniformly throughout the entire system so that remote radiators receive steam as quickly as radiators located near the boiler.

Although the heating system of the '113 patent may improve steam flow to distant radiators, its application and benefit to engine cooling systems may be limited. That is, the '113 patent describes a self-pressurizing heating system and may not account for pressure drops in an engine system (e.g. a pressure drop across a pump from the engine to a heat exchanger). Neglecting these types of pressure drops can have adverse effects on engine performance and engine wear.

The disclosed cooling system is directed to overcoming one or more of the problems set forth above.

SUMMARY

In one aspect, the present disclosure is directed to a cooling system. The cooling system may include an engine, a pump configured to receive coolant from the engine and generate a flow of coolant, and a heat exchanger configured to receive the coolant flow. The cooling system may also include a plurality of orifice plates located between the pump and the heat exchanger. At least one of the plurality of orifice plates may be adjustable to control the flow of the coolant from the engine to the heat exchanger.

In another aspect, the present disclosure is directed to a method of installing a power system. The method may include installing an engine, and installing a heat exchanger configured to receive and cool pressurized coolant from the engine. The method may also include adjusting at least one of a plurality of orifice plates to control coolant flow from the engine to the heat exchanger based on a distance from an installation location of the engine to an installation location of the heat exchanger.

DETAILED DESCRIPTION

Figure 1:
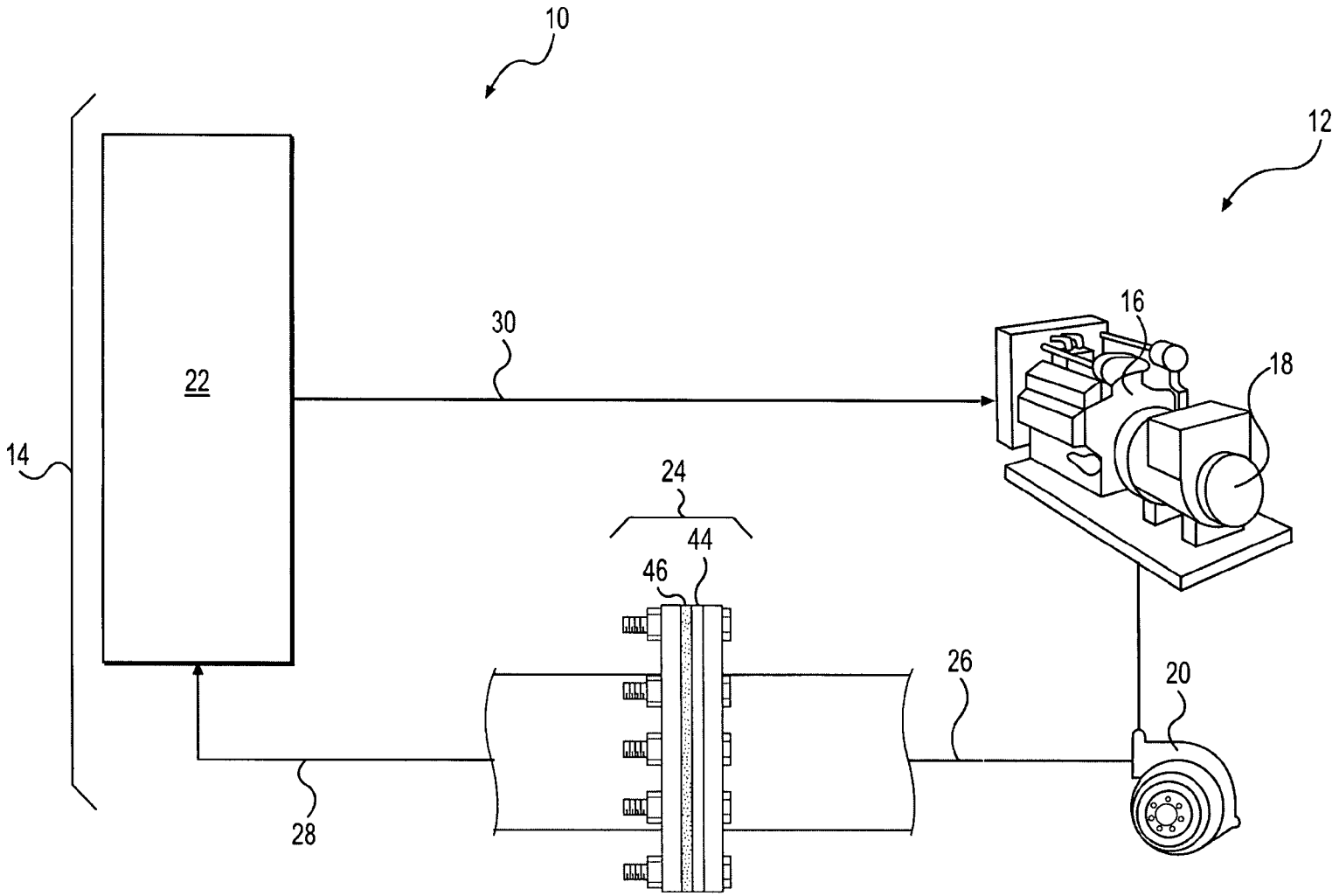
FIG. 1 is a schematic illustration of an exemplary disclosed cooling system.

FIG. 1 illustrates an exemplary power system 10. Power system 10 may be configured to provide primary and/or backup power to an external load (not shown). In one exemplary embodiment, backup power may include an immediate supply of reserve power provided to an external load when power supplied from a utility power grid (not shown) is interrupted. As shown in FIG. 1, power system 10 may comprise a generator set (genset) 12 and a cooling system 14. Although only one genset 12 is shown, it is contemplated that power system 10 may include any number of gensets 12. Gensets 12 may be connected to each other and connected to the external load by way of a power transmission network (not shown). Cooling system 14 may include components that facilitate cooling of genset 12.

Genset 12 may include components that cooperate to generate electricity. In one embodiment, genset 12 may comprise an engine 16 coupled to mechanically rotate a generator 18 that provides electrical power to the external load. For the purposes of this disclosure, engine 16 may embody any type of heat engine, for example, a combustion engine that combusts a mixture of fuel and air to produce the mechanical rotation. One skilled in the art will recognize that engine 16 may be any type of combustion engine such as, for example, a diesel engine, a gasoline engine, or a gaseous fuel-powered engine.

Generator 18 may be, for example, an AC induction generator, a permanent-magnet generator, an AC synchronous generator, or a switched-reluctance generator that is mechanically driven by engine 16 to produce electrical power. In one embodiment, generator 18 may include multiple pairings of poles (not shown), each pairing having three phases arranged on a circumference of a stator (not shown) to produce an alternating current. Electrical power produced by generator 18 may be directed for offboard purposes to the external load.

Cooling system 14 may include multiple components configured to cool engine 16 and/or generator 18. Specifically, cooling system 14 may include a pump 20 and a heat exchanger 22. Coolant such as water, glycol, a water/glycol mixture, a blended air mixture, air, or any other heat transferring fluid may be pressurized by pump 20 and directed through heat exchanger 22 to release heat, and then drawn back to engine 16.

In one embodiment, pump 20 may be engine-driven to generate the flow of coolant described above. In particular, pump 20 may include an impeller (not shown) disposed within a volute housing having an inlet and an outlet. As the coolant enters the volute housing, blades of the impeller may be rotated by operation of engine 16 to push against the coolant, thereby pressurizing the coolant. An input torque imparted by engine 16 to pump 20 may be related to a pressure of the coolant, while a speed imparted to pump 20 may be related to a flow rate of the coolant. It is contemplated that pump 20 may alternatively embody a piston type pump, if desired, and may have a variable or constant displacement.

Heat exchanger 22 may be situated to dissipate heat from the coolant after it passes through engine 16. Heat exchanger 22 may be a liquid-to-liquid or an air-to-liquid type of exchanger. That is, a flow of air or other selected liquid may be directed through channels of heat exchanger 22 such that heat from the coolant in adjacent channels is transferred to the air or liquid. In this manner, the coolant passing through engine 16 may be cooled to below a predetermined operating temperature of engine 16.

A cooling fan (not shown) may be associated with heat exchanger 22 to generate the flow of cooling air. In particular, the fan may include an input device (not shown) such as a belt driven pulley, a hydraulically driven motor, or an electrically powered motor that is mounted to engine 16, and fan blades (not shown) fixedly or adjustably connected thereto. The cooling fan may be powered by engine 16 to cause the fan blades to blow or draw air across heat exchanger 22. It is contemplated that the cooling fan may additionally blow or draw air across engine 16 for external cooling thereof, if desired.

A set of adjustable orifice plates 24 may be used to regulate the amount of coolant flowing to heat exchanger 22 after exiting engine 16 and/or to regulate a pressure drop across pump 20. Coolant may be pressurized by pump 20 and directed through a coolant line 26 to adjustable orifice plates 24 and then through a coolant line 28 to heat exchanger 22. After exiting heat exchanger 22, coolant may be drawn through a passageway 30 back to engine 16.

Figure 2:
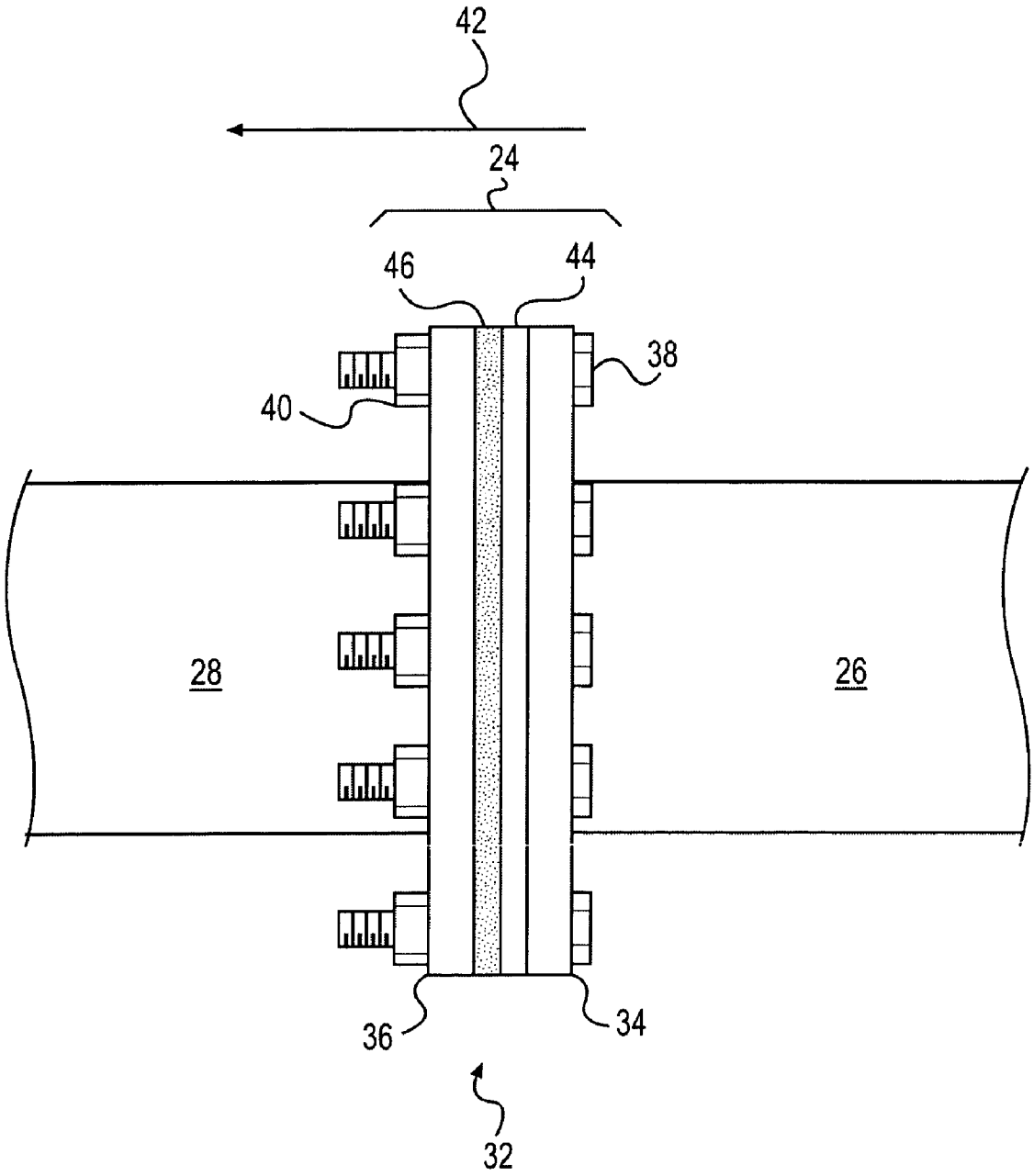
FIG. 2 is an enlarged diagrammatic illustration of adjustable orifice plates installed in the cooling system of FIG. 1.

FIG. 2 illustrates an exemplary embodiment of adjustable orifice plates 24 located between coolant line 26 and coolant line 28, at an outlet of engine 16. Adjustable orifice plates 24 may be located on a pressure side of pump 20, upstream of heat exchanger 22. Adjustable orifice plates 24 may be installed at an existing connection 32 that connects coolant line 26 to coolant line 28. In one embodiment, connection 32 may comprise a flange 34 connect to coolant line 26, and a flange 36 connected to coolant line 28. Flange 34 and flange 36 may be joined together with a plurality of connecting bolts 38 and a plurality of nuts 40. Adjustable orifice plates 24 may be installed between flange 34 and flange 36, and held in place by connecting bolts 38 and nuts 40. A flow arrow 42 illustrates the flow of coolant in cooling system 14 through adjustable orifice plates 24.

Figure 3:
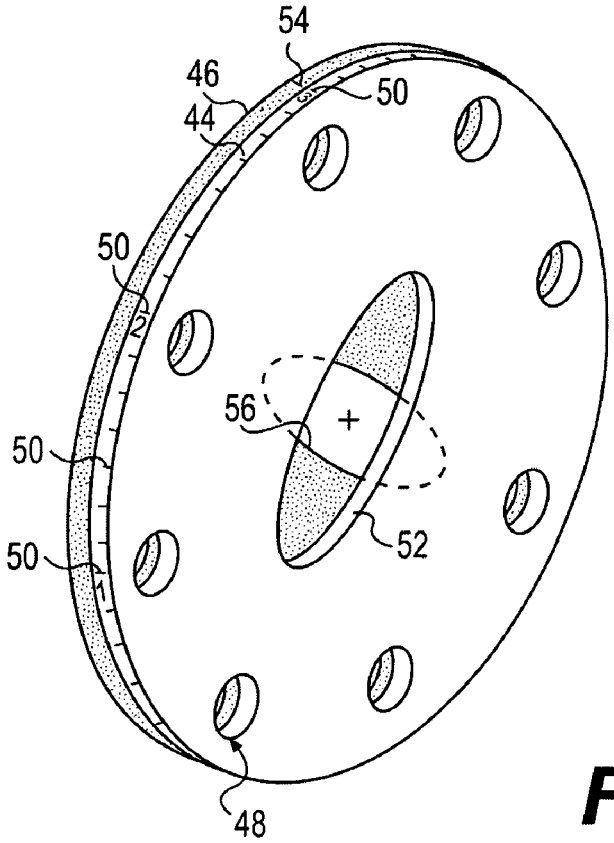
FIGS. 3-7 are diagrammatic illustrations of exemplary adjustable orifice plates of FIG. 2.
Figure 4:
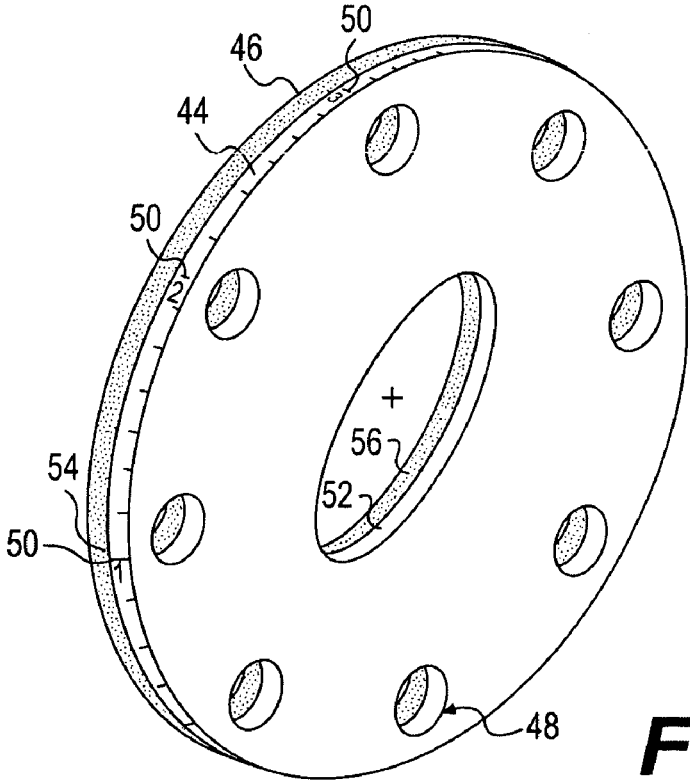

FIGS. 3 and 4 illustrate an exemplary embodiment of adjustable orifice plates 24. Adjustable orifice plates 24 may include a first orifice plate 44 and a second orifice plate 46. First orifice plate 44 and second orifice plate 46 may have a plurality of mounting holes 48 corresponding to the plurality of connecting bolts 38. This arrangement may allow adjustable orifice plates 24 to be installed in existing connection 32, between flange 34 and flange 36. To install first orifice plate 44 and second orifice plate 46, connecting bolts 38 may be removed from flange 34 and flange 36. First orifice plate 44 and second orifice plate 46 may be located between flange 34 and flange 36, and connecting bolts 38 reinserted into flange 34, through mounting holes 48, and into flange 36.

In one embodiment, first orifice plate 44 may have indicia 50 located on an outer periphery thereof. Indicia 50 may indicate a distance, a pressure, or both. First orifice plate 44 may have a central opening 52. Central opening 52 may have a symmetrical shape such as elliptical, circular, triangular, or any other shape, symmetrical or non-symmetrical.

Second orifice plate 46 may also have reference indicia 54 located on an outer periphery thereof. Indicia 50 of first orifice plate 44 maybe substantially aligned with reference indicia 54 of second orifice plate 46 when the first orifice plate 44 and second orifice plate 46 are assembled. Second orifice plate 46 may have a central opening 56. Central opening 56 may have a symmetrical shape such as elliptical, circular, triangular, or any other shape, symmetrical or non symmetrical. Central opening 56 may or may not be identical to central opening 52.

FIG. 3 illustrates central opening 52 of first orifice plate 44 substantially offset from central opening 56 of second orifice plate 46. Specifically, FIG. 3 shows central opening 52 of first orifice plate substantially perpendicular to central opening 56 of second orifice plate 46. When heat exchanger 22 is installed at a location close to the installation location of engine 16, a lower relative flow of coolant within the cooling system 14 may be desired. In this situation, indicia 50 of first orifice plate 44 indicating a corresponding distance may be aligned with reference indicia 54 of second orifice plate 46, and then adjustable orifice pates 24 may be installed between flange 34 and flange 36. Similarly, when there is a small pressure drop across pump 20, a lower flow of coolant in cooling system 14 may be desired. In this situation, indicia 50 of first orifice plate 44 indicating a small pressure drop may be aligned with reference indicia 54 of second orifice plate 46. This lower flow of coolant within cooling system 14 may be achieved by offsetting central opening 52 of first orifice plate 44 with central opening 56 of second orifice plate 46, such that a flow opening through adjustable orifice plates 24 is reduced. This decreased flow of coolant within cooling system 14 may help reduce wear to heat exchanger 22 and components of engine 16. In addition, the decreased flow may help prevent overcooling of engine 16.

FIG. 4 illustrates central opening 52 of first orifice plate 44 substantially aligned with central opening 56 of second orifice plate 46. When heat exchanger 22 is installed distal from the location of engine 16 a greater relative flow of coolant within cooling system 14 may be desired. In this situation, indicia 50 of first orifice plate 44 indicating a corresponding distance may be aligned with reference indicia 54 of second orifice plate 46, and then adjustable orifice pates 24 may be installed between flange 34 and flange 36. Similarly, when there is a large pressure drop across pump 20, a greater flow of coolant within cooling system 14 may be desired. In this situation, indicia 50 of first orifice plate 44 indicating a large pressure drop may be aligned with reference indicia 54 of second orifice plate 46. A greater flow of coolant within cooling system 14 may be achieved by substantially aligning central opening 52 of first orifice plate 44 with central opening 56 of second orifice plate 46, such that a flow opening through adjustable orifice plates 24 is increased. This increased flow of coolant within cooling system 14 may increase the cooling capability of heat exchanger 22

Central opening 52 of first orifice plate 44 may be substantially offset with central opening 56 of second orifice plate 46 at a position substantially in between that of FIG. 3 and FIG. 4. When heat exchanger 22 is installed at an intermediate location relative to engine 16, an intermediate flow of coolant within the cooling system 14 may be desired. In this situation, indicia 50 of first orifice plate 44 indicating a corresponding distance may be aligned with reference indicia 54 of second orifice plate 46, and then the adjustable orifice pates 24 may be installed between flange 34 and flange 36. Similarly, when there is an intermediate pressure drop across pump 20, an intermediate flow of coolant in cooling system 14 may be desired. In this situation, indicia 50 of first orifice plate 44 indicating an intermediate pressure drop may be aligned with reference indicia 54 of second orifice plate 46. This intermediate flow of coolant within cooling system 14 may be achieved by offsetting central opening 52 of first orifice plate 44 with central opening 56 of second orifice plate 46, such that an opening through adjustable orifice plates is increased or decreased as desired. This intermediate flow of coolant within cooling system 14 may help maximize the component life of heat exchanger 22 and engine 16. In addition, the intermediate flow may help maximize the cooling capability of heat exchanger 22.

Figure 5:
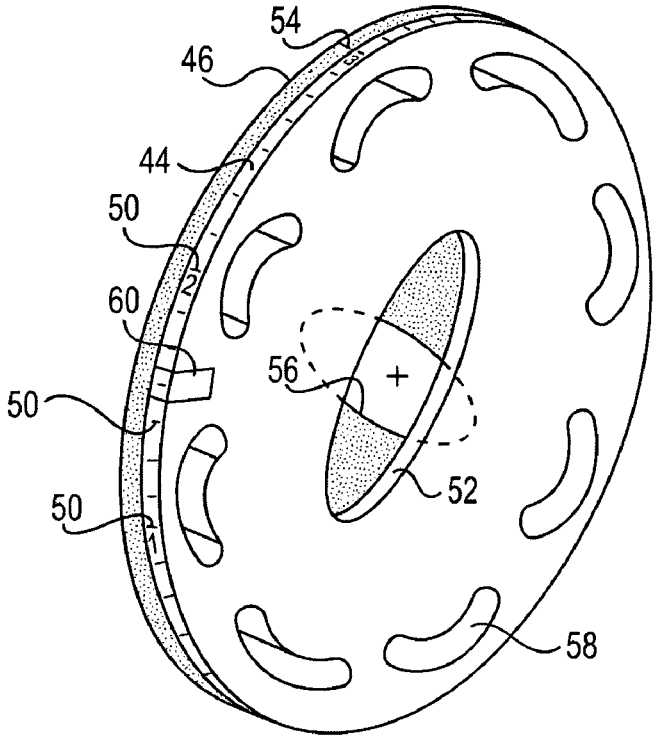

FIG. 5 illustrates an embodiment of first orifice plate 44 having a plurality of mounting grooves 58 in place of mounting holes 48. Mounting grooves 58 may be larger than mounting holes 48, and allow first orifice plate 44 to be rotatably adjusted relative to second orifice plate 46 without removal of connecting bolts 38. Specifically, a service technician may only have to loosen connecting bolts 38 to rotatably adjust first orifice plate 44 relative to second orifice plate 46. In this embodiment, first orifice plate 44 may also have a gripping notch 60 that allows a service technician to grip and rotate first orifice plate 44 when it is installed between flange 34 and flange 36. Mounting grooves 58 and gripping notch 60 may allow first orifice plate 44 to be finely adjusted in order to optimize coolant flow in cooling system 14.

Figure 6:
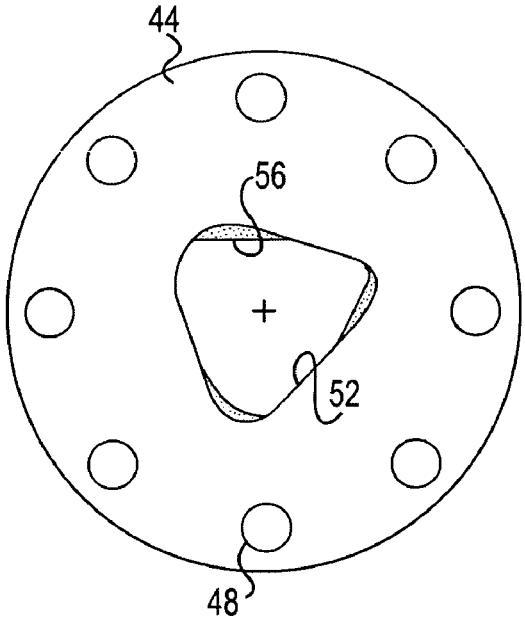

FIG. 6 illustrates central opening 52 of first orifice plate 44 and central opening 56 of second orifice plate 46 as having a generally triangular shape. Adjustable orifice plates 24 having triangular shaped openings may be installed and adjusted in the same way as described above. The triangular opening may provide various sized flow openings through adjustable orifice plates 24.

Figure 7:
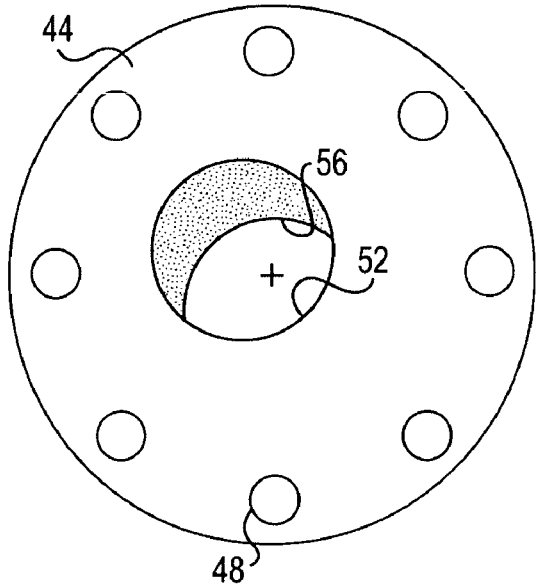

FIG. 7 illustrates central opening 52 of first orifice plate 44 and central opening 56 of second orifice plate 46 as having circular openings that are offset from a center of each plate. The circular shape and offset nature of the openings may provide various sized flow openings through adjustable orifice plates 24.

INDUSTRIAL APPLICABILITY

The disclosed cooling system may be used in any power system application where a heat exchanger may be installed at varying distances from an associated engine. In particular, the disclosed cooling system may provide optimal coolant flow when the heat exchanger is installed at any distance from the installation location of the engine such that optimal power system performance is realized. The disclosed system may provide coolant flow flexibility by incorporating adjustable orifice plates in the cooling system. The operation of cooling system 14 will now be described.

During operation of coolant system 14, coolant may be pressurized by pump 20 and directed through coolant line 26 and coolant line 28 to heat exchanger 22 to release heat. After exiting heat exchanger 22, the coolant may be drawn through passageway 30, through engine 16, and back to pump 20. The distance between the installation locations of heat exchanger 22 and engine 16 may vary. For example, heat exchanger 22 may be installed close to engine 16 or as far as about 30 feet from engine 16. If the distance is too close, the flow from engine 16 through heat exchanger 22 can be too great and cause wear to the heat exchanger and other engine components. In addition, the increased flow can cool the engine too much. When heat exchanger 22 is mounted too far from engine 16, the cooling capability of heat exchanger 22 decreases, resulting in overheating of engine 16 or poor fuel efficiency.

In order to maintain proper coolant flow in cooling system 14, adjustable orifice plates 24 may be installed on the pressure side of the pump 20, upstream of heat exchanger 22. The distance between the installation location of engine 16 and the installation location of heat exchanger 22 may be measured. Indicia 50 of first orifice plate 44 corresponding to the measure distance may be aligned with reference indicia 54 of second orifice plate 46. Indexing first orifice plate 44 may adjust central opening 52 of first orifice plate 44 relative to central opening 56 of second orifice plate 46, and thereby optimize the opening flow areas for coolant to pass through. After first orifice plate 44 is indexed, connecting bolts 38 may be removed from flange 34 and flange 36 to install second orifice plate 46 on flange 36 of coolant line 28 and install first orifice plate 44 on flange 34 of coolant line 26. Connecting bolts 38 then may be reinserted into flange 36, second orifice plate 46, first orifice plate 44, and flange 34.

In order to maintain proper coolant flow in cooling system 14, adjustable orifice plates 24 may alternatively or additionally be adjusted based on pressure. The pressure drop across pump 20 my be measured. Connecting bolts 38 may be loosened, first orifice plate 44 may be gripped at gripping notch 60, and first orifice plate 44 may be rotated relative to second orifice plate 46 corresponding to the measured pressure drop. Connecting bolts 38 may then be tightened. Additionally adjusting first orifice plate 44 may adjust central opening 52 of first orifice plate 44 relative to central opening 56 of second orifice plate 46, and thereby further optimize the opening flow area for coolant to pass through.

Because the disclosed cooling system may regulate the flow of coolant based on the distance between the heat exchanger and the engine, or based on a pressure drop across pump 20, operation of engine 16 may be improved and wear on the heat exchanger and engine may be reduced.

It will be apparent to those skilled in the art that various modifications and variations can be made to the disclosed cooling system without departing from the scope of the disclosure. Other embodiments of the cooling system will be apparent to those skilled in the art from consideration of the specification and practice of the cooling system disclosed herein. It is intended that the specification and examples be considered as exemplary only, with a true scope of the disclosure being indicated by the following claims and their equivalents.

What is claimed is:

1. A cooling system comprising:

an engine;

a pump configured to receive coolant from the engine and generate a coolant flow;

a heat exchanger configured to receive the coolant flow; and a plurality of orifice plates located between the pump and the heat exchanger, wherein at least one of the plurality of orifice plates is adjustable relative to at least one other of the plurality of orifice plates to control the coolant flow from the engine to the heat exchanger.

2. The cooling system of claim 1, wherein the at least one of the plurality of orifice plates is adjustable based on a distance between the engine and the heat exchanger.

3. The cooling system of claim 2, wherein the at least one of the plurality of orifice plates includes distance-identifying indicia.

4. The cooling system of claim 1, wherein:

the plurality of orifice plates include a first orifice plate and a second orifice plate;

the first orifice plate has a first opening;

the second orifice plate has a second opening;

the first opening is substantially aligned with the second opening when the first orifice plate is in a first position; and the first opening is substantially offset from the second opening when the first orifice plate is in a second position.

5. The cooling system of claim 4, wherein the first orifice plate has a third position substantially between the first and second positions.

6. The cooling system of claim 4, wherein the first and second openings have an elliptical shape.

7. The cooling system of claim 4, wherein:

the first and second openings have a circular shape; and the first and second openings are offset from a center of the first and second orifice plates.

8. The cooling system of claim 4, wherein the first and second openings have a generally triangular shape.

9. The cooling system of claim 1, wherein the at least one of the plurality of orifice plates is adjustable based on a pressure drop across the pump.

10. The cooling system of claim 9, wherein at least one of the plurality of orifice plates include a plurality of mounting grooves.

11. The cooling system of claim 10, wherein the at least one of the plurality of orifice plates has a gripping notch to grip the at least one of the plurality of orifice plates.

12. The cooling system of claim 9, wherein the at least one of the plurality of orifice plates includes pressure-identifying indicia.

13. A generator set, comprising:

an engine;

a generator driven by the engine to produce electrical power;

a pump driven by the engine to pressurize coolant directed through the engine and the generator;

a heat exchanger configured to receive and cool the pressurized coolant; and a plurality of orifice plates located between the engine and the heat exchanger, wherein at least one of the plurality of orifice plates is adjustable relative to at least one other of the plurality of orifice plates to regulate a flow of the pressurized coolant exiting the engine.

14. The generator set of claim 13, wherein the plurality of orifice plates are adjustable to regulate the flow of pressurized coolant based on one of a distance and a pressure.

15. The generator set of claim 13, wherein the plurality of orifice plates include central openings having one of an elliptical, circular or triangular shape.

16. The generator set of claim 13, wherein at least one of the plurality of orifice plates includes a plurality of mounting grooves and a gripping notch to grip the at least one of the plurality of orifice plates.

17. A cooling system comprising:

an engine;

a pump configured to receive coolant from the engine and generate a coolant flow;

a heat exchanger configured to receive the coolant flow; and a plurality of orifice plates located between the pump and the heat exchanger, wherein at least one of the plurality of orifice plates is rotationally adjustable to control the coolant flow from the engine to the heat exchanger.

18. A generator set, comprising:

an engine;

a generator driven by the engine to produce electrical power;

a pump driven by the engine to pressurize coolant directed through the engine and the generator;

a heat exchanger configured to receive and cool the pressurized coolant; and a plurality of orifice plates located between the engine and the heat exchanger, wherein at least one of the plurality of orifice plates is rotationally adjustable to regulate a flow of the pressurized coolant exiting the engine.

* * * * *